US007471248B2

(12) United States Patent
Popugaev et al.

(10) Patent No.: US 7,471,248 B2
(45) Date of Patent: Dec. 30, 2008

(54) PLANAR MULTIBAND ANTENNA

(75) Inventors: Alexander Popugaev, Erlangen (DE); Rainer Wansch, Hagenau (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

(21) Appl. No.: 11/844,530

(22) Filed: Aug. 24, 2007

(65) Prior Publication Data

US 2007/0296635 A1 Dec. 27, 2007

Related U.S. Application Data

(63) Continuation of application No. PCT/EP2006/001661, filed on Feb. 23, 2006.

(30) Foreign Application Priority Data

Mar. 9, 2005 (DE) ..... 10 2005 010 894

(51) Int. Cl.
*H01Q 1/38* (2006.01)

(52) U.S. Cl. ..... 343/700 MS

(58) Field of Classification Search ..... 343/700 MS, 343/833, 846

See application file for complete search history.

(56) References Cited

U.S. PATENT DOCUMENTS

| | | | | |
|---|---|---|---|---|
| 4,809,008 | A * | 2/1989 | Gunton | 343/700 MS |
| 4,903,033 | A | 2/1990 | Tsao et al. | |
| 5,001,493 | A * | 3/1991 | Patin et al. | 343/700 MS |
| 5,633,645 | A | 5/1997 | Day | |
| 5,952,971 | A | 9/1999 | Strickland | |
| 6,008,763 | A | 12/1999 | Nystrom et al. | |
| 6,018,319 | A | 1/2000 | Lindmark | |
| 6,885,342 | B2 * | 4/2005 | Saegrov et al. | 343/700 MS |
| 2002/0171595 | A1 | 11/2002 | Schultze et al. | |
| 2003/0052825 | A1 | 3/2003 | Rao et al. | |
| 2004/0027292 | A1 | 2/2004 | Gabriel et al. | |

(Continued)

FOREIGN PATENT DOCUMENTS

EP 0 700 117 A1 3/1996

(Continued)

OTHER PUBLICATIONS

Jung et al., "A Dual Band Antenna for WLAN Applications by Double Rectangular Patch with 4 Bridges", published by the Department of Electrical Engineering and COmputer Science, University of California, Irvine, Irvine CA, 92697, USA. http://www.ece.uci.edu/rfmems/publications/papers/antenna/C089-APS04.pdf.*

(Continued)

*Primary Examiner*—Michael C Wimer
(74) *Attorney, Agent, or Firm*—Keating & Bennett, LLP

(57) ABSTRACT

The present invention provides a planar multiband antenna having a ground area, a first radiation electrode, a second radiation electrode, a third radiation electrode and a feeder. The feeder is implemented to feed the first radiation electrode. The first radiation electrode is arranged at least partly between the ground area and the second radiation electrode and does not protrude from an external periphery of the third radiation electrode. The third radiation electrode is arranged such that it completely surrounds an external periphery of the second radiation electrode, wherein there is a gap between the second radiation electrode and the third radiation electrode.

17 Claims, 8 Drawing Sheets

U.S. PATENT DOCUMENTS

| | | | |
|---|---|---|---|
| 2004/0239567 | A1 | 12/2004 | Van Der Poel |
| 2005/0225498 | A1 | 10/2005 | Koparan et al. |
| 2006/0012524 | A1 | 1/2006 | Mierke et al. |

FOREIGN PATENT DOCUMENTS

| | | | |
|---|---|---|---|
| EP | 1 072 065 | B1 | 3/2002 |
| EP | 0 939 975 | B1 | 10/2003 |
| EP | 1 006 608 | B1 | 5/2004 |

OTHER PUBLICATIONS

Kabacik et al.: "A Circulary Polarized Antenna Element for Highly Integrated Array Antennas," University of Technology, Poland, 2003; 2 pages.

Popugaev et al.: "Aperature-Coupled Antenna," U.S. Appl. No. 11/844,520; filed on Aug. 24, 2007.

Official communication issued in counterpart International Application No. PCT/EP2006/001056, mailed on May 26, 2006.

Choi et al.: "Compact Size IMT-2000 Microstrip Antenna for Repeater and Base Stations," IEEE Antennas and Propogation Society International Symposium; Jul. 2001, pp. 34-37.

Huang et al.: "Slot-Coupled Microstrip Antenna for Broadband Circular Polarisation," Electronics Letters; Apr. 30, 1998; vol. 34, No. 9; 2 pages.

Chiou et al.: "A Compact Dual-Band Dual Polarized Patch Antenna for 900/1800-MHz Cellular Systems," IEEE Transactions on Antennas and Propagation; vol. 51, No. 8; Aug. 2003, pp. 1936-1940.

Sanchez-Hernandez et al.: "A Survey of Broadband Microstrip Patch Antennas," Microvave Journal, Sep. 1996; pp. 60-84.

Wong: "Planar Antennas for Wireless Communications," Wiley-Interscience; Jan. 2003; pp. 203-263.

Pozar: "A Review of Aperture Coupled Microstrip Antennas: History, Operation, Development, and Applications," May 1996; www.ecs.umass.edu/ece/pozar/aperature.pdf; 12 pages.

Zurcher et al.: "Broadband Patch Antennas," SSFIP Principle; Chapter 3; Artech House, Boston, London; Mar. 1995; pp. 45-61.

Jung et al.: "A Dual-Band Antenna for WLAN Applications by Double Rectangular Patch WTIH 4-Bridges," Antennas and Propogation Society International Symposium IEEE; Department of Electrical Engineering and Computer Science, University of California; Jun. 2004.

Pozar et al., "A Dual-Band Circularly Polarized Aperture-Coupled Stacked Microstrip Antenna for Global Positioning Satellite," IEEE Transactions on Antennas and Propagation, vol. 45, No. 11; Nov. 1997; pp. 1618-1625.

Wiesmann: Diploma Thesis "Examination and Setup of Multi-Band Antennas for Receiving of Circulary Polarized Signals," Friedrich-Alexander-Universitat, Erlangen-Nurnberg; Dec. 17, 2002; 109 pages.

Pozar: "Microstrip Antenna Aperature-Coupled to A Microstripline," Electronic Letters, Jan. 1985, vol. 21, No. 2; pp. 49-50.

Pozar: "A Reciprocity Method of Analysis for Printed Slot and Slot-Coupled Microstrip Antennas," IEEE Transactions on Antennas and Propagation; Dec. 1986, vol. AP-34, No. 12; pp. 1439-1446.

Sullivan et al.: "Analysis of an Aperture Coupled Microstrip Antenna," IEEE Transactions on Antennas and Propagation; Aug. 1986; vol. AP-34, No. 8; pp. 977-984.

Adrian et al.: "Dual Aperture-Coupled Microstrip Antenna for Dual or Circular Polarisation," Electronics Letters; Nov. 5, 1987; vol. 23, No. 23; pp. 1226-1227.

Gao et al.: "Network Modeling of an Aperture Coupling Between Microstrip Line and Patch Antenna for Active Array Applications," IEEE Transactions on Microwave Theory and Techniques, Mar. 1988; vol. MTT-36, No. 3; pp. 505-513.

Tsao et al.: "Aperture Coupled Patch Antennas With Wide-Bandwith and Dual-Polarization Capabilities," IEEE Antennas and Propagation Symposium Digest, 1988, pp. 936-939.

Zurcher: "The SSFIP: A Global Concept for High-Performance Broadband Planar Antennas," Electronics Letters; Nov. 10, 1988; vol. 24, No. 23; pp. 1433-1435.

Himdi et al.: "Analysis of Aperture Coupled Microstrip Antenna Using Cavity Method," Electronics Letters; Mar. 16, 1989; vol. 25, No. 6; pp. 391-392.

Himdi et al.: "Transmission Line Analysis of Aperture-Coupled Microstrip Antenna," Electronics Letters; Aug. 31, 1989; vol. 25, No. 18; pp. 1229-1230.

Pozar: "Analysis of an Infinite Phased Array of Aperture Coupled Microstrip Patches," IEEE Transactions on Antennas and Propogation; Apr. 1989; vol. AP-37, No. 4; pp. 418-425.

Croq et al.: "Large Bandwith Aperture-Coupled Microstrip Antenna," Electronics Letters, Aug. 2, 1990; vol. 26, No. 16; pp. 1293-1294.

Croq et al.: "Millimeter-Wave Design of Wide-Band Aperture-Coupled Stacked Microstrip Antennas," IEEE Transactions on Antennas and Propagation; Dec. 1991; vol. 39, No. 12; pp. 1770-1776.

Croq et al.: "Stacked Slot-Coupled Printed Antenna," IEEE Microwave and Guided Wave Letters; Oct. 1991; vol. 1, No. 10; pp. 288-290.

Ittipiboon et al.: "A Modal Expansion Method of Analysis and Measurement On Aperture-Coupled Microstrip Antenna," IEEE Transactions On Antennas and Propagation; Nov. 1991; vol. AP-39, No. 11; pp. 1567-1574.

Wu et al.: "Study on Series-Fed Aperture-Coupled Microstrip Patch Array," IEEE; 1990; pp. 1762-1765.

Edimo et al.: "Optimised Feeding of Dual Polarised Broadband Aperture-Coupled Printed Antenna," Electronics Letters; Sep. 1992, vol. 28, No. 19; pp. 1785-1787.

Ohmine et al.: "An MMIC Aperture-Coupled Microstrip Antenna in the 40GHz Band," Proceedings of ISAP, 1992, pp. 1105-1108.

Pan et al.: "Computation of Mutual Coupling Between Slot-Coupled Microstrip Patches in A Finite Array," IEEE Transactions on Antennas and Propagation; Sep. 1992; vol. 40, No. 9; pp. 1047-1053.

Yazidi et al.: "Transmission Line Analysis of Nonlinear Slot Coupled Microstrip Antenna," Electronics Letters; Jul. 16, 1992, vol. 28, No. 15; pp. 1406-1408.

Dich et al.: "A Network Model for the Aperture Coupled Microstrip Patch," International Journal of Microwave and Millimeter-Wave Computer-Aided Engineering, 1993; vol. 3, No. 4; pp. 326-339.

Targonski et al.: "Design of Wideband Circularly Polarized Aperture-Coupled Microstrip Antennas," IEEE Transactions on Antennas and Propagation; Feb. 1993; vol. 41, No. 2; pp. 214-220.

Edimo et al.: "Wideband Dual Polarised Aperture-Coupled Stacked Patch Antenna Array Operating in C-Band," Electronics Letters; Jul. 21, 1994; vol. 30, No. 15; pp. 1196-1198.

Simons et al.: "Analysis of Aperture-Coupled Microstrip-Antenna and Circuit Structures Using the Transmission-Line-Matrix Method," IEEE Antennas and Propagation Magazine; Aug. 1995; vol. 37, No. 19; pp. 27-36.

Park et al.: "Aperature-Coupled Small Microstrip Antenna," Electronics Letters; Sep. 12, 1996; vol. 32, No. 19; pp. 1741-1742.

Sanford et al.: "A Two Substrate Dual Polarised Aperture Coupled Patch," IEEE International Symposium on Antennas and Propagation; 1996; pp. 1544-1547.

Targonski et al.: "An Aperture Coupled Stacked Patch Antenna With 50% Bandwidth," IEEE International Symposium on Antennas and Propagation; 1996; pp. 18-21.

Vlasits et al.: "Performance of A Cross-Aperture Coupled Single Feed Circularly Polarised Patch Antenna," Electronics Letters; Mar. 28, 1996; vol. 23, No. 7; pp. 612-613.

Eleftheriades et al.: "ALPSS: A Millimeter-Wave Aperture-Coupled Patch Antenna on A Substrate Lens," Electronics Letters; Jan. 30, 1997; vol. 33, No. 3; pp. 169-170.

Yau et al.: "Numerical Analysis of an Aperture Coupled Microstrip Patch Antenna Using Mixed Potential Integral Equations and Complex Images," Progress in Electromagnetics Research; 1998; pp. 229-244.

Karmakar et al.: "Circularly Polarized Aperture-Coupled Circular Microstrip Patch Antennas for L-Band Applications," IEEE Transactions on Antennas and Propagation; May 1999; vol. 47, No. 5; pp. 933-940.

Kossel et al.: "Circular Polarized Aperture Coupled Patch Antennas for an RFID System in the 2.4 GHz ISM Band," http://www.rawcon.org/rawcon99/slidesW1_2.pdf; 1999, pp. 235-238.
Huang et al.: "Cross-Slot-Coupled Microstrip Antenna and Dielectric Resonator Antenna for Circular Polarization," IEEE Transactions on Antennas and Propagation; Apr. 1999; vol. 47, No. 4; pp. 605-609.
Lu: "Broadband Operation of A Slot-Coupled Compact Rectangular Microstrip Antenna With A Chip-Resistor Loading," Proc. Natl. Sci. Counc. ROC(A); 1999; vol. 23, No. 4; pp. 550-554.
Jung: "Electromagnetically Coupled Rectangular Patch Microstrip Antenna for Circular Polarization," Proceedings of the 1999 Graduate Studies Conference, GRADCON'99; Oct. 1, 1999; 1 page.
Chung et al.: "A Broadband Singly-Fed Electromagnetically Coupled Patch Antenna for Circular Polarisation," Faculty of Engineering, Telecommunications Group Cooperative Research Centre for Satellite Systems; University of Technology; 2000; 5 pages.
Koers et al.: "Large Aprture Coupled Microstrip Patch Antenna Arrays: Proposal for the Opto-Electronic Control of Micro and MM-Wave Radiation?" Vrije Universiteit Brussell Lab for Micro-and Optoelectronics Department; 2000; 4 pages.
Pozar et al.: "A Comparison of Commercial Software Packages for Microstrip Antenna Analysis," 2000; http://anteg.net/tuli/paperspdf/conference/20-APS-Saltlake-2000.pdf; 4 pages.
Wu et al.: "Design and Characterization of Single and Multiple Beam MM-Wave Circularly Polarized Substrate Lens Antennas for Wireless Communications," IEEE Transactions on Microwave Theory and Techniques; 2001; vol. 49, No. 3; pp. 2408-2411.
Prata Jr.: "Misaligned Antenna Phase-Center Determination Using Measured Phase Patterns," IPN Progress report; Aug. 15, 2002; pp. 1-9.

* cited by examiner

PLANAR MULTIBAND ANTENNA

CROSS-REFERENCE TO RELATED APPLICATIONS

This application is a continuation of copending International Application No. PCT/EP2006/001661, filed Feb. 23, 2006, which designated the United States and was not published in English.

BACKGROUND OF THE INVENTION

1. Field of the Invention

The present invention generally relates to a planar multiband antenna, in particular to an aperture-coupled circularly polarized planar dual-band antenna which can be employed in ISM bands from 2.40 GHz to 2.48 GHz and 5.15 GHz to 5.35 GHz.

2. Description of the Related Art

Wireless systems which have to function in several frequency bands are being developed more frequently. Frequently, compact antennas are necessary to keep the setup volume of the antennas small and to allow usage in portable devices.

It is possible to provide a separate antenna for each frequency band to be used. The disadvantage of using separate antennas, however, is that a multiplexer has to be employed. In addition, the area necessary for the antennas increases when using separate antennas.

Receiving from several different wireless transfer systems by a single broadband antenna is problematic since broadband antennas cannot usually be manufactured at low cost in a compact design. If all the relevant systems are to be received by a single broadband antenna, this will not be possible using a small cheap antenna.

A multi-element antenna having a special radiator for every frequency range can be used for receiving several frequency bands. Most antenna concepts known which are suitable for receiving from two or more frequency bands (dual-band concept and/or multiband concept) and which can be used for and/or in patch antennas, such as, for example, integrated inverted-F antennas (IFAs) and planar inverted-F antennas (PIFAs), comprise only a linear polarization. Well-known antenna shapes of this kind are, for example, described in the book "Planar Antennas for Wireless Communications" by Kin-Lu Wong (John Wiley & Sons, Inc., Hoboken, N.J., 2003).

However, it is desirable in particular for mobile applications to use a circular polarization, since in this case the orientation of transmitting and receiving antennas is uncritical, whereas when using linear polarization, the orientation of the antennas has to be selected appropriately.

A series of antennas which may be integrated comprising a circular polarization are known, however many of the geometries which may be integrated comprise essential disadvantages for generating a circular polarization. Exemplarily, nearly squared patches (planar conductive areas) of coaxial feeding have a low impedance bandwidth, as is, for example, described in the dissertation "Untersuchung und Aufbau von Multibandigen Antennen zum Empfang zirkular polarisierter Signale" by U. Wiesman produced in 2002 at the Fraunhofer-Institut für integrierte Schaltungen in Erlangen. Another multiband antenna of coaxial feeding is described in the article "A Dual Band Antenna for WLAN Applications by Double Rectangular Patch with 4 Bridges" by Chang Won Jung and Franco De Flaviis, published by the Department of Electrical Engineering and Computer Science, University of California, Irvine, Irvine, Calif., 92697, USA.

One way of setting up a circularly polarized dual-band antenna is using aperture coupling. Such a solution is described in the article "A Dual-Band Circularly Polarized Aperture-Coupled Stacked Microstrip Antenna for Global Positioning Satellite" by D. M. Pozar and S. M. Duffy, published in IEEE Transactions on Antennas and Propagation, Vol. 45, No. 11, in November 1997. However, it is employed for broadband antennas of a resonant frequency or for antennas of several resonant frequencies close to one another, but not suitable for being employed in connection with multiband antennas.

The European patent document EP 1 072 065 B1 shows a double-band antenna for GSM and DCS having double polarization. Antenna elements stacked above one another are fed by a cross-shaped aperture in the reflector device. Microwave energy is guided by a coupling area segment and an also cross-shaped aperture in a first radiating area segment to a second radiating area segment. The disadvantage of such an antenna assembly is that in this antenna two feeding channels have to be combined by a quadrature hybrid broadband extension line coupler in order to generate a circular polarization. In addition, the European patent document does not mention purity of polarization and impedance bandwidth.

The European patent application EP 1 353 405 A1 suggests an antenna for two frequency bands (dual-band antenna) which is suitable for both the GSM 900 band and the GSM 1800 band and the UMTS band and is based on a single radiator type. The individual antennas comprise a metallic box open to the top and feeding through conductive traces and/or conductor patterns. The individual radiators are further implemented to comprise an octahedral aperture in the center and can consequently be placed one above the other. The disadvantage of the antennas described is that they comprise a complicated and not completely planar structure.

In summary, it can be stated that no antenna design which is easy as far as the technology involved is concerned and can be realized at low cost is known which allows, with good efficiency and sufficient bandwidth, radiation of a circularly polarized electromagnetic wave in two different frequency bands.

SUMMARY OF THE INVENTION

According to an embodiment, a planar multiband antenna may have: a ground area; a first radiation electrode, a second radiation electrode and a third radiation electrode; and feeding means which is implemented to feed the first radiation electrode, wherein the first radiation electrode is arranged at least partly between the ground area and the second radiation electrode and does not protrude from an external periphery of the third radiation electrode; wherein the third radiation electrode is arranged to completely surround an external periphery of the second radiation electrode with a gap therebetween; wherein the third radiation electrode is arranged on that side of the first radiation electrode facing away from the ground electrode; and wherein the third radiation electrode and the second radiation electrode are connected to each other via four conductive connection lands.

Put differently, in a parallel projection of the second radiation electrode and the third radiation electrode in an image plane, the image of the third radiation electrode completely encloses the second radiation electrode, wherein there is a gap between the image of the third radiation electrode and the image of the second radiation electrode. The first radiation electrode is at least partly between the second radiation electrode and the ground area, wherein the region between the second radiation electrode and the ground area is defined by the fact that rays passing from the second radiation electrode to the ground area in a manner normal to the surface of the second radiation electrode, pass through the region between the second radiation electrode and the ground area. The region between the second radiation electrode and the ground area consequently is a region which would be swept by the second radiation electrode if it was shifted in a direction normal to its surface towards the ground area.

Thus, the first radiation electrode in the meaning of the above definition is between an area delineated by an external periphery of the third radiation electrode, and the ground area. This means that the first radiation electrode does not protrude from the external periphery of the third radiation electrode.

The central idea of embodiments of the present invention is that a planar multiband antenna of particularly advantageous features can be achieved by arranging the first radiation electrode between the ground area and a combination of the second radiation electrode and the third radiation electrode, wherein the third radiation electrode is arranged such that it completely encloses an external periphery of the second radiation electrode, wherein there is a gap between an external periphery of the second radiation electrode and an internal periphery of the third radiation electrode. A maximum dimension of the first radiation electrode thus is smaller than a maximum dimension of the third radiation electrode. The first radiation electrode which is at least partly between the second radiation electrode and the ground area here can serve as a radiator for an upper frequency range. In a lower frequency range, i.e. exemplarily in a frequency band having a lower frequency than the upper frequency range, the second radiation electrode and the third radiation electrode, which are further away from the ground area than the first radiation electrode, together can act as a radiating element. A gap between the second radiation electrode and the third radiation electrode which completely encloses the second radiation electrode allows the first radiation electrode, when operated in the upper frequency band, to be able to radiate electromagnetic waves into free space. Put differently, the gap between the external periphery of the second radiation electrode and the internal periphery of the third radiation electrode prevents the second and third radiation electrodes, which together are larger than the first radiation electrode, to shield off radiation from the first radiation electrode.

It is also to be mentioned that the second radiation electrode the dimensions of which can be similar to the first radiation electrode, still supports radiation from the first radiation electrode. Coupling the first radiation electrode and the second radiation electrode here can be of positive influence on the bandwidth of the antenna for radiation in the upper frequency band, in which the first radiation electrode is effective as a radiating element.

It is pointed out that the first radiation electrode which is effective in the upper frequency band as a radiating element has a smaller distance to the ground area than the second and third radiation electrodes. The result is effectively suppressing and/or minimizing surface waves from forming in the upper frequency band, which would impede the antenna gain and/or the antenna's efficiency considerably, compared to arrangements in which a radiation electrode for the upper one of two frequency bands is arranged spaced apart from the ground area.

In addition, it is possible in a suitable manner to couple the inventive antenna. It is sufficient to provide feeding means which feeds the first, smaller radiation electrode. When operating in the upper frequency band, the first radiation electrode is in resonance, so that effective direct coupling of the first radiation electrode is possible. When operating in the lower frequency band, however, the first radiation electrode is not in resonance and thus transfers the energy fed to it to the combination of the second radiation electrode and the third radiation electrode which when operating in the lower frequency band is effective as a radiating element. Thus, separate feeding for the lower frequency band and the upper frequency band can be dispensed with. In addition, no duplexer is necessary and the feeding means can have a correspondingly simple design. Exciting circularly polarized radiation can in an inventive antenna take place in an advantageous manner and including only one feeding means. In operation in the upper frequency band, the lower, first radiation electrode can be excited directly. In operation in the lower frequency band, the first radiation electrode can be excited, wherein the latter in turn transfers the electrical energy to the second and third radiation electrodes.

An inventive antenna geometry also allows coupling the first radiation electrode by aperture coupling. Compared to coaxial feeding, an aperture-coupled antenna has a particularly large impedance bandwidth, thereby making the inventive antenna particularly suitable for broadband applications. In aperture coupling, energy is at first coupled from a wave guide to the first radiation electrode since it is closer to the ground area than the second and third radiation electrodes. The first radiation electrode thus is in direct and uninterfered electromagnetic coupling to the aperture in the ground area so that the polarization of an electromagnetic wave radiated by the first radiation electrode when operating in the upper frequency band can be set particularly effectively by the design of the aperture and the excitation. Exemplarily, the radiation of a circularly polarized wave is possible with a high degree of polarization purity. In operation in the lower frequency band, the first radiation electrode has the effect of a coupling electrode since it is not operated in resonance. It will transfer the electrical power coupled through the aperture of the ground area to the second radiation electrode and the third radiation electrode which together comprise resonance and thus particularly good emission in the lower frequency band. Good purity of a desired polarization can also be ensured when radiating in the lower frequency band by the second and third radiation electrodes.

The arrangement of the first radiation electrode and the second and third radiation electrodes ensures that surface waves will only be excited to a small extent, since when radiating in the upper frequency band the relevant distance between the first radiation electrode and the ground area is smaller than the distance between the second and third radiation electrodes and the ground area. Thus, the distance between the respective active radiation electrode and the ground area is adjusted to the wavelength of the radiation emitted (small distance for the upper frequency band; great distance for the lower frequency band), so that surface waves can be reduced optimally.

It is also to be pointed out that the inventive antenna can, as far as technology is concerned, be manufactured with great advantage since the entire structure is planar.

It is also mentioned that the inventive antenna differs considerably from all structures known. Conventionally, in planar dual-band antennas a large radiation electrode for a lower frequency band is arranged closer to the ground area than a small radiation electrode for an upper frequency band, should the two radiating elements overlap. However, overlapping is desirable for reasons of saving space. According to conventional opinion, an arrangement in which a smaller radiator is arranged between a larger radiator and the ground area is not sensible, since conventionally it is assumed that the larger radiator will then shield radiation from the smaller radiator. Known antenna assemblies thus do not allow surface waves to be minimized as described before. In addition, common feeding of radiators for different frequency bands is not possible in conventional antennas when a high degree of polarization purity is important. Thus, achieving circular polarization of high polarization purity is not possible by a conventional assembly including only one feed.

In an inventive antenna, the third radiation electrode thus is implemented such that, in a projection of the second radiation electrode and the third radiation electrode along a direction normal to the second radiation electrode in an image plane, an image of the third radiation electrode completely encloses an image of the second radiation electrode.

It is advantageous for the second radiation electrode and the third radiation electrode to be in one plane, the third radiation electrode completely enclosing the second radiation electrode in this plane. Such an arrangement is of advantage since in this case the second radiation electrode and the third radiation electrode together form a radiator in a particularly advantageous manner comprising resonance for the lower one of two frequency bands. In addition, the arrangement described is of advantage as far as manufacturing technology is concerned, since the second radiation electrode and the third radiation electrode can be deposited and patterned on a common substrate. Furthermore, the arrangement described allows manufacturing connections between the second radiation electrode and the third radiation electrode in technologically simple ways.

Furthermore, it is advantageous for a distance between the third radiation electrode and the second radiation electrode to be smaller than a distance between the third radiation electrode and the first radiation electrode. Thus, the third radiation electrode is closer to the second radiation electrode than to the first radiation electrode. This ensures than an interaction between the second radiation electrode and the third radiation electrode is greater than an interaction between the first radiation electrode and the third radiation electrode. It is ensured by this that the first radiation electrode in the upper frequency band has a resonance which is not influenced essentially by the third radiation electrode. However, in the lower frequency band, the second radiation electrode and the third radiation electrode can interact strongly so that the second radiation electrode and the third radiation electrode together can be considered as one large radiator.

In another embodiment, the first radiation electrode, the second radiation electrode, the third radiation electrode and the feeding means are implemented such that the planar multiband antenna is able to radiate circularly polarized electromagnetic waves. For this purpose, an external shape of the first radiation electrode, the second radiation electrode and the third radiation electrode can, for example, be set such that the first radiation electrode, the second radiation electrode and the third radiation electrode are almost squared, wherein there is a slight difference in the dimensions and/or edge lengths. In addition, it is possible for the first radiation electrode, the second radiation electrode and the third radiation electrode to be rectangular and/or almost squared and furthermore to comprise at least one bevelled corner. In addition, it is possible to provide the first radiation electrode and the second radiation electrode with at least one slot in the center which favors and/or allows a circularly polarized wave to be radiated. In addition, it can be ensured by means of suitable feeding that a circularly polarized wave is radiated. Exemplarily, the first radiation electrode can be coupled, by an aperture in the ground area, to a wave guide which supplies electrical power to the first radiation electrode, i.e. feeds same. The aperture may, for example, be a cross-aperture since this is particularly suitable for achieving circular polarization. However, it is also possible to feed the first radiation electrode via a coaxial line, wherein suitable selection of the feeding point ensures circular polarization. In addition, the first radiation electrode can be excited by two feeding lines arranged at different positions, wherein it must be ensured that the signals on the feed lines have such a phase offset that a circularly polarized wave will be radiated. Generating a circularly polarized radiation is of particular advantage since this allows realizing a transfer link where the field intensity received is independent on a rotation of the antenna round an axis connecting a transmit antenna and a receive antenna. It is also to be pointed out that the inventive antenna structure is particularly suitable for radiating a circularly polarized wave, wherein it is sufficient to feed only the first radiation electrode. The first radiation electrode either is effective itself in the upper frequency band as a radiating element or passes on, in the lower frequency band, the electrical power fed to it to the second and third radiation electrodes, without considerably impeding the polarization characteristics in the lower frequency band.

A particularly advantageous feeding allowing a large bandwidth can be achieved when the feeding means includes an aperture in the ground area and a wave guide, wherein the first radiation electrode, the second radiation electrode and the third radiation electrode are arranged spaced apart from the ground area on a first side of the ground area, and wherein the wave guide is arranged on a second side of the ground area. The wave guide and the first radiation electrode thus are arranged such that energy from the wave guide can be coupled via the aperture to the first radiation electrode to feed the first radiation electrode. The wave guide and the aperture here can be implemented so as to allow a circularly polarized electromagnetic wave to be radiated. It has proven to be of particular advantage in such an aperture coupling for the aperture to comprise at least one first slot and one second slot which together form a slot in the shape of a cross.

Furthermore, it is advantageous for the first radiation electrode and the second radiation electrode to comprise equal shapes. This ensures that an external periphery of the first radiation electrode is basically parallel to an external periphery of the second radiation electrode and to the gap between the second radiation electrode and the third radiation electrode. Thus, radiation from the first radiation electrode can be emitted to free space particularly effectively, without the second radiation electrode and the third radiation electrode developing a marked shielding effect.

Furthermore, a maximum dimension of the second radiation electrode in an embodiment differs by at most 30% from a maximum dimension of the first radiation electrode. This in turn ensures that the external periphery of the first radiation electrode is sufficiently close to the gap between the second radiation electrode and the third radiation electrode. This allows emitting radiation from the first radiation electrode through the gap between the second and third radiation electrodes to free space.

In addition, it is advantageous for a maximum dimension of the second radiation electrode to differ by at most 10% from a maximum dimension of the first radiation electrode, wherein the resonant frequencies of the first radiation electrode and the second radiation electrode differ only slightly. Thus, strong coupling can form between the first radiation electrode and the second radiation electrode, thereby the second radiation electrode supporting radiation of the first radiation electrode. Also, the bandwidth of the inventive antenna can be increased by this, since two coupled resonant radiators, namely the first radiation electrode and the second radiation electrode, comprise a higher bandwidth than a single radiator. In addition, using equal dimensions for the first radiation electrode and the second radiation electrode entails the advantages mentioned before and is consequently of advantage.

In another embodiment, the third radiation electrode and the second radiation electrode are coupled to each other via a conductive connection. The conductive connection may, for example, be at least one conductive connective land. Thus, it is ensured that the second radiation electrode and the third radiation electrode are effective in the lower frequency band as one common big radiation electrode. This will also be true if field-coupling between the second radiation electrode and the third radiation electrode is not sufficiently strong. The conductive connective lands can be connected to the second radiation electrode in the center of external edges of the second radiation electrode. However, the conductive connective lands may also be shifted from the center of the edges towards the corners. When the second radiation electrode has bevelled corners, it is of particular advantage to shift the connective lands towards the bevelled corners. The position of the connective lands is able to influence a resonant frequency and matching of the second radiation electrode and the third radiation electrode. Thus, the position of the connective lands represents a further degree of freedom when designing an inventive antenna. It is of advantage to employ four conductive connective lands between the third radiation electrode and the second radiation electrode, since the result of this are the most uniform radiation characteristics of the inventive antenna possible.

It is also of advantage for a plane in which the first radiation electrode is situated, a plane in which the second radiation electrode is situated, and a plane in which the third radiation electrode is situated each to span a positive angle of at most 20° with the ground area. The first radiation electrode, the second radiation electrode and the third radiation electrode are thus essentially parallel to the ground area. This design allows a planar setup and the radiation characteristics in turn are uniform.

The inventive antenna is implemented such that impedance matching is obtained with a standing wave ratio of smaller than 2 in at least two frequency bands. Thus, two-band operation and/or multiband operation of the inventive antenna is possible, wherein good matching is achieved. Good matching allows effective coupling of energy to the antenna.

The inventive antenna may be formed in several layers. In an embodiment, the inventive antenna comprises a first dielectric layer, a first layer of low dielectric constant, a second dielectric layer, a second layer of low dielectric constant, and a third dielectric layer. The first dielectric layer supports a wave guide on its first surface and the ground area on its second surface. The second dielectric layer supports the first radiation electrode on one side. The third dielectric layer supports the second radiation electrode and the third radiation electrode. The first layer of low dielectric constant is arranged between the first dielectric layer and the second dielectric layer. The dielectric constant of the first layer of low dielectric constant is smaller than the dielectric constant of the first dielectric layer, the second dielectric layer and the third dielectric layer. The second layer of low dielectric constant is arranged between the second dielectric layer and the third dielectric layer. The dielectric constant of the second layer of low dielectric constant is smaller than the dielectric constant of the first, second or third dielectric layers.

Such an implementation of an antenna allows particularly easy manufacturing, wherein the radiation characteristics of the antenna can be improved by the layers of low dielectric constant. A layer of very low dielectric constant reduces dielectric losses and also reduces surface waves occurring. In addition, the manufacturing is very favorable since only radiation electrodes which are supported by dielectric layers have to be processed. Thus, methods can be employed which allow patterning of planar layers on a support material, such as, for example, photolithographic methods. Methods of this kind are very cheap and offer very high precision. In addition, the dielectric layers supporting the radiation electrodes guarantee good mechanical stability for the antenna. A particularly easy and cheap manufacturing can be achieved by manufacturing the first, the second and the third dielectric layers from FR4 material (conventional circuit board material). The layer of low dielectric constant may be formed by air. It has been shown that an inventive antenna, with a corresponding design, can be manufactured extremely cheaply, wherein the radiation characteristics are not influenced negatively despite the cheap materials used.

Other features, elements, processes, steps, characteristics and advantages of the present invention will become more apparent from the following detailed description of preferred embodiments of the present invention with reference to the attached drawings.

BRIEF DESCRIPTION OF THE DRAWINGS

Embodiments of the present invention will be detailed subsequently referring to the appended drawings, in which.

DETAILED DESCRIPTION OF PREFERRED EMBODIMENTS

Figure 1:
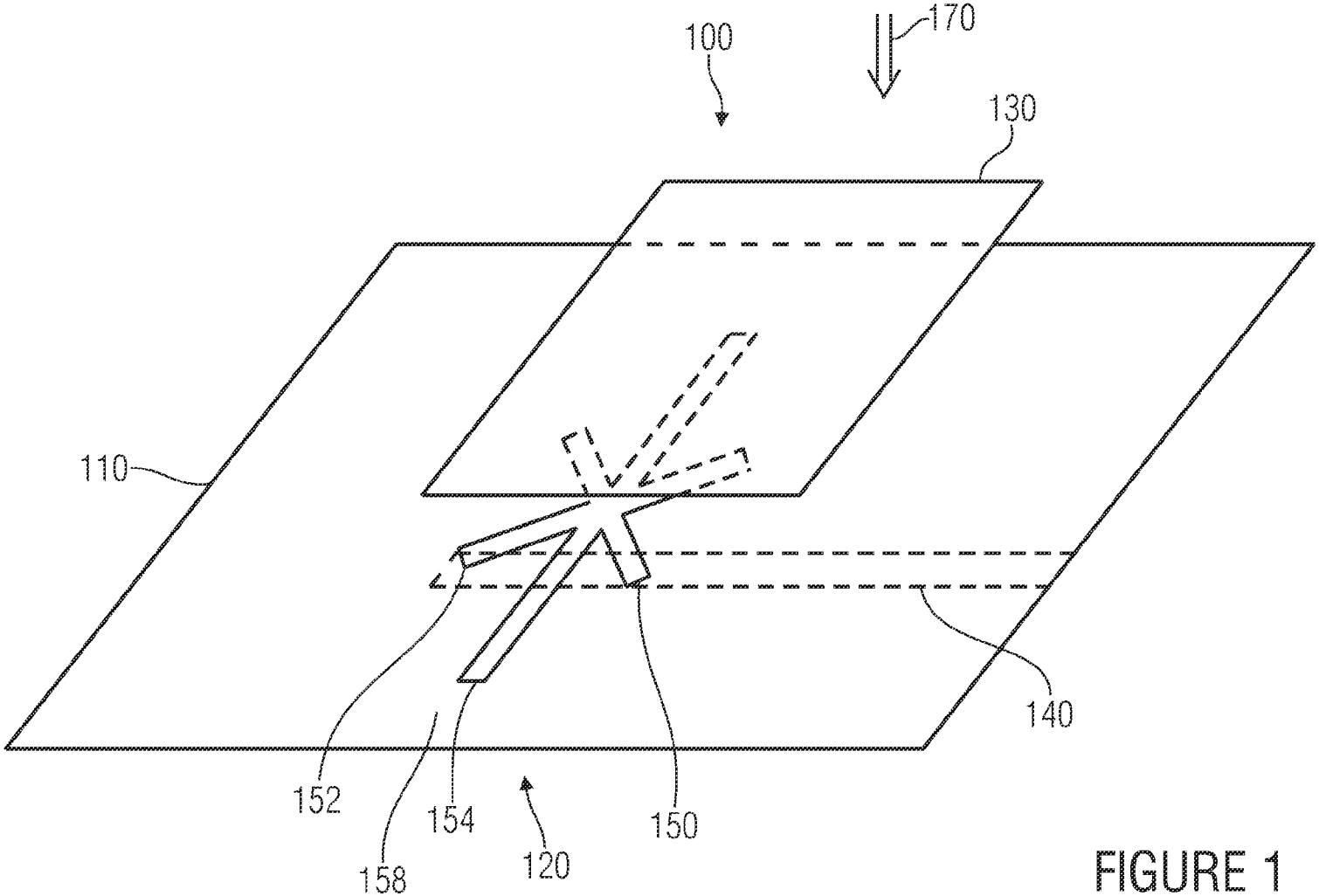
FIG. 1 shows a tilted image of a planar antenna structure from which an inventive antenna structure may be derived.

FIG. 1 shows a tilted image of a planar antenna structure from which an inventive antenna structure may be derived. The antenna structure in its entirety is referred to by 100. The antenna structure 100 includes a ground area 110 comprising an aperture 120. In addition, the antenna structure includes a radiation electrode 130 arranged above the ground area 110. A feeding line 140 which is shown here as a conducting strip is arranged below the ground area 110. The aperture 120 includes a first slot 150, a second slot 152 and a third slot 154. The first, second and third slots 150, 152, 154 each have a rectangular shape and represent an opening of the ground area 110. The first slot 150 and the second slot 152 are arranged so as to form a cross. The lengths of the first slot 150 and the second slot 152 in the embodiment shown are equal. The third slot 154 is longer than the first slot 150 and the second slot 152 and intersects the first and second slots 150, 152 in the region in which the first and second slots 150, 152 also intersect, i.e. in the center of the cross formed by the first and second slots. In addition, it is to be pointed out that the third slot 154 in a top view, along a direction shown by an arrow 170, is perpendicular to the feed line 140. Furthermore, the aperture 120 comprises a high degree of symmetry. The geometrical centers of the first, second and third slots 150, 152, 154, except for manufacturing tolerances, coincide. In addition, there is axis symmetry of the aperture relative to an axis 158 of the third slot 154. In addition, the aperture 120 is arranged relative to the feed line 140 such that the feed line 140, in top view, passes through the region in which the first, second and third slots 150, 152, 154 intersect.

The radiation electrode 130 is a planar conductive electrode which may also be referred to as patch. In the embodiment shown it is arranged above the aperture 120. The radiation electrode 130 shown is basically rectangular. The radiation electrode 130 is implemented to allow a circularly polarized electromagnetic wave to be radiated. In the embodiment shown, the radiation electrode is nearly squared. However, it is also possible to use a rectangular radiation electrode in which at least one corner is bevelled and/or cut off. Also, a radiation electrode comprising a slot in the center which allows circular polarization can be used. Finally, different geometries may be used, as long as it is ensured that they allow circular polarization. The radiation electrode 130 is arranged such that the aperture 120, in a top view, along a direction characterized by the arrow 170 is symmetrical below the radiation electrode 130.

Furthermore, it is to be pointed out that, all in all, the wave guide and the radiation electrode are arranged such that energy from the wave guide can be coupled through the aperture to the radiation electrode (patch).

The mode of functioning of the present antenna structure can be described easily. The aperture 120 forms a resonant cross-aperture. The first slot 150 and the second slot 152 form a slot in the shape of a cross. The slots are dimensioned such that no resonance of the cross-shaped slot occurs in the operating frequency range of the antenna. Thus, it is achieved that an oscillation resulting in a circularly polarized electromagnetic wave to be radiated is excited on the radiation electrode. The cross-shaped form of the first and second slots 150, 152 of the aperture 120 contributes to exciting a suitable mixed vibrational mode allowing such a circular polarization of the waves radiated. The third slot 154 is operated close to its resonance so that it contributes to improving the matching of the antenna described. As is shown, the third slot 154 is typically longer than the first and second slots 150, 152, wherein the slot 154 is operated closer to resonance that the first and second slots. Furthermore, it is to be pointed out that it is amazing that the third slot 154 does not interfere in the circular polarization of the electromagnetic wave radiated, as might be expected according to conventional theories.

The geometry shown can be changed in a wide range. Exemplarily, lengths of the three slots 150, 152, 154 which form the aperture 120 can be altered. Exemplarily, the length of the third slot 154 can be increased or reduced. In addition, it is not necessary for the first slot 150 and the second slot 152 to have the same length. Rather, the lengths of the slots 150, 152, 154 relative to one another can be changed to allow fine adjustments of the antenna structure. It is furthermore also possible to deviate from the strict symmetry of the aperture. This may, for example, be useful when the radiation electrode 130 has no complete symmetry either. With regard to the angles between the slots and between a slot and the feed line, alterations may also be made. Rotation of the slots by up to 20 degrees is possible to allow fine tuning of the antenna structure. Thus, the angle between the first slot and the second slot can deviate from a right angle by up to 20 degrees. This is similarly also true for the angle between the third slot and the feed line.

The radiation electrode 130 can be changed over a wide range. It may, for example, be rectangular or nearly rectangular. It is of advantage to use a radiation electrode which is nearly squared, wherein the dimensions and/or edge lengths differ slightly. Such a radiation electrode allows a circularly polarized electromagnetic wave to be radiated. It is also possible to use a radiation electrode which has a nearly rectangular or squared shape, wherein at least one corner is bevelled. In this case, it is also of advantage for reasons of symmetry to bevel two opposite corners. Finally, a radiation electrode which comprises a slot in the center can be used, wherein the slot thus is implemented such that a circularly polarized wave can be radiated. Conventional extensions are possible, like, for example, coupling additional metallic elements to the radiation electrode 130. In addition, parasitic elements, of, for example, a capacitive, conductive or resistive type, can be coupled to the radiation electrode 130. Thus, a desired mode forming can be forced. Apart from that, the bandwidth of the antenna can be improved by parasitic elements. Finally, it is possible to cut off and/or bevel corners of the radiation electrode 130. The result is coupling of different vibrational modes between the radiation electrode 130 and the ground area 110. As a consequence, a suitable phase shift is made between the different modes so that a right-hand circular polarization or left-hand one can be set. In addition, the radiation electrode may also be altered differently, exemplarily by adding slots to the radiation electrode which suppress undesired modes or provide for a suitable phase relation between the desired modes.

Feeding the antenna structure shown can take place in different ways. The metallic strip conductor 140 shown here can be replaced by different wave guides. Exemplarily, these wave guides may be a microstrip line. In addition, a coplanar wave guide can be used. Additionally, electrical energy can also be fed by a strip line, a dielectric wave guide or a cavity wave guide.

Additionally, it is pointed out that FIG. 1 merely represents a schematical illustration of the basic structure of a planar antenna. Characteristics which are not essential for the antenna are not illustrated here. Thus, it is to be pointed out that the metallic structures shown, in particular the ground area 110, the radiation electrode 130 and the strip line 140, are typically supported by dielectric materials. It is possible to introduce nearly any layers or structures of dielectric materials into the antenna structure 100 shown. Structures of this kind may, for example, be layers parallel to the ground area 110. The conducting structures may be deposited on these dielectric layers and may have been patterned by a suitable method, exemplarily an etching method. The only prerequisite here is that the dielectric constant of a dielectric layer be not too large since this increases losses resulting in the antenna structure, and radiation is deteriorated. In addition, when introducing dielectric structures, it must be kept in mind that no surface waves should be excited, since they, too, also deteriorate the radiation efficiency of an antenna structure considerably.

A dielectric layer may, for example, be arranged between the ground area 110 and the strip conductor 140, the result being a microstrip line. Such a microstrip line is of particular advantage for coupling an antenna structure described. In addition, a microstrip line can also be combined particularly well with active and passive circuit structures.

Dielectric structures of different shapes are also possible apart from planar dielectric structures. Exemplarily, the radiation electrode 130 can be supported by a spacer made of a dielectric material. Such a design improves the mechanical stability of the antenna and allows cheap manufacturing.

A combination of dielectric layers and layers of very low dielectric constant, such as, for example, air layers, is also possible. Air layers reduce electrical losses and may reduce surface waves excited.

Figure 2:
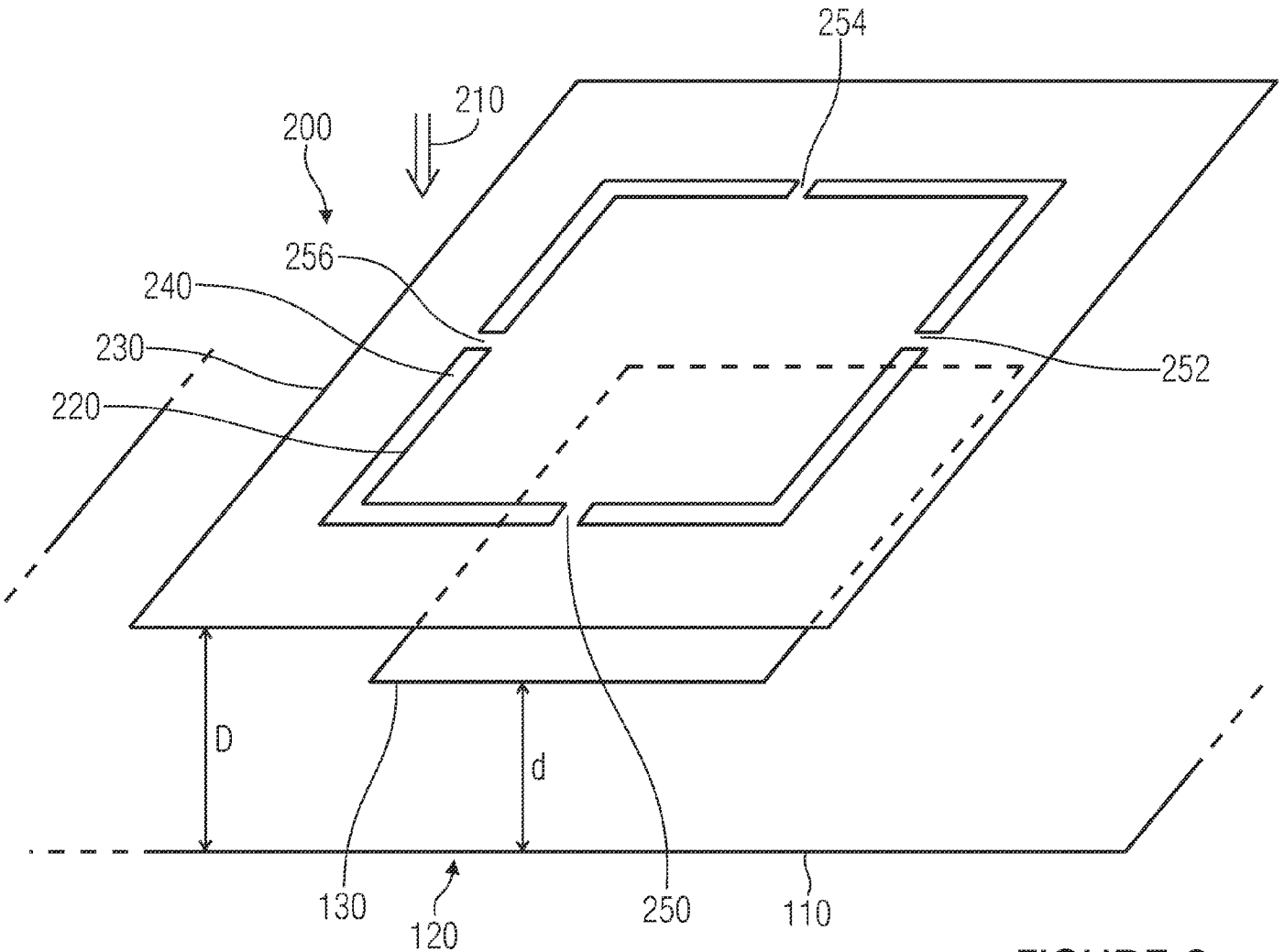
FIG. 2 shows a tilted image of an inventive radiator geometry according to a first embodiment of the present invention.

FIG. 2 shows a tilted image of an inventive radiator geometry according to a second embodiment of the present invention. The radiator geometry in its entirety is referred to by 200. It is pointed out that in FIGS. 1 and 2 and also in the remaining figures, same reference numerals refer to same means. A ground area 110 comprising an aperture 120 is shown here. Specific details of the aperture are not shown here for reasons of clarity, however the aperture corresponds to the one described and shown in FIG. 1. Additionally, the inventive radiator geometry 200 includes a first radiation electrode 130. The aperture 120 represents an opening in the ground area 110 which in a top view along a direction characterized by the arrow 210 is below the first radiation electrode 130. A second radiation electrode 220 is arranged above the first radiation electrode. It is enclosed by the third radiation electrode 230, wherein there is a gap 240 between the second radiation electrode 220 and the third radiation electrode 230. The second radiation electrode 220 is connected to the third radiation electrode 230 via four conductive lands 250, 252, 254, 256. These lands in the implementation shown are arranged roughly in the center of the edges of the second radiation electrode 220. The second radiation electrode 220 is thus arranged such that the first radiation electrode 130 is between the second radiation electrode 220 and the ground area 110. In the embodiment shown, the second radiation electrode 220 and the third radiation electrode 230 additionally are in a common plane. Furthermore, the dimensions of the second radiation electrode 220 differ only slightly from the dimensions of the first radiation electrode 130. The deviation is advantageously less than 20%.

Based on the structural description, the mode of functioning of an inventive radiator geometry will be explained in greater detail below. It is pointed out that such a geometry allows setting up circularly polarized dual- and/or multiband antennas. The individual layers can be supported by different boards. Exemplarily, a first board of a dielectric material can support the ground area 110, whereas a second board supports the first radiation electrode 130 and a third board supports the second radiation electrode 220 and the third radiation electrode 230. The boards, however, are not shown here for reasons of clarity, but may be arranged such that the respective radiation electrodes are supported by any board surface. At the bottom of a printed circuit board supporting the ground area 110, there may be a microstrip line from which power is transferred through the aperture 120 in the ground area first to a smaller patch formed by the first radiation electrode 130. The smaller patch formed by the first radiation electrode 130 is designed for the upper frequency band of two frequency bands. The power coupled by the aperture can subsequently be coupled onto a larger patch which is designed for the lower one of two frequency bands. The larger patch effectively includes two patches which in the embodiment shown are formed by the second radiation electrode 220 and the third radiation electrode 230. The larger patch here may be interpreted as two patches within each other having short circuits. The inner smaller patch formed by the second radiation electrode 220 is approximately as large as the bottom smaller patch formed by the first radiation electrode 130. Conductive connection lands 250, 252, 254, 256 connect the second radiation electrode 220 and the third radiation electrode 230. Depending on their positions, the connecting lands 250, 252, 254, 256 act on the second radiation electrode and the third radiation electrode as capacitive or inductive load and/or coupling, thereby having an effect on the resonant frequency of the upper radiator formed by the second radiation electrode 220 and the third radiation electrode 230. A change in the position of a connecting land 250, 252, 254, 256 (relative to the second and third radiation electrodes 220, 230 and relative to the remaining connective lands) can thus be used for fine tuning of the antenna structure. Exemplarily, it is possible to move the connecting lands 250, 252, 254, 256 from the center of the edges of the second radiation electrode 220 towards the corners of the second radiation electrode 220. In case two corners of the second radiation electrode 220 are bevelled, it has proven to be of advantage to move the connecting lands 250, 252, 254, 256 towards these bevelled and/or cut corners. In addition, it is to be pointed out that the connecting lands need not be arranged in a strictly symmetrical manner. Rather, it is practical to arrange the connecting lands 250, 252, 254, 256 at opposite edges of the second radiation electrode slightly offset so that a connecting line between two opposite connecting lands 250, 252, 254, 256 is not parallel to an edge of the second radiation electrode. Particularly great freedom when fine tuning the upper radiator results from such an asymmetrical arrangement. Finally, it should be pointed out that the connecting lands may also be omitted when there is sufficient near-field coupling between the second radiation electrode 220 and the third radiation electrode 230.

The inventive structure thus effectively includes two radiative structures, namely a so-called lower patch which is formed by the first radiation electrode 130 and is effective at higher frequencies, and an upper, larger patch which is formed by the second radiation electrode 220 and the third radiation electrode 230.

It is additionally to be pointed out that the distance between the small patch formed by the first radiation electrode 130 and the ground area is smaller than the distance between the second larger patch formed by the second radiation electrode 220 and the third radiation electrode 230, and the ground area 110.

An inventive structure offers considerable advantages compared to known structures, wherein a circularly polarized radiation can be achieved in two frequency bands without considerably influencing the purity of polarization or without exciting surface waves to a greater extent.

It is pointed out here that generally an increase in an electrical substrate thickness results in higher-order surface waves forming. When surface waves of this kind form, the antenna gain is reduced strongly. In order to avoid and/or keep low the formation of surface waves, the two antenna structures contained in an inventive geometry have different effective substrate thicknesses for different frequency ranges. At lower frequencies, the upper, larger patch formed by the second radiation electrode 220 and the third radiation electrode 230 is effective. The effective substrate thickness equals the distance of the second and third radiation electrodes from the ground area 110. This distance is indicated here by D. However, at higher frequencies, the lower, small patch formed by the first radiation electrode 130 becomes effective. The effective substrate thickness equals the distance between the first radiation electrode 130 and the ground area 110 which is indicated here by d.

It shows that the effective substrate thickness for low frequencies referred to by D is larger than the effective substrate thickness for higher frequencies referred to by d. This corresponds to the requirement that antennas for different frequencies must have different substrate thicknesses. Due to the fact that the radiators effective at different frequencies are in different planes and in different distances to the ground area 110, the generation of surface waves is reduced effectively. The very requirement that the effective substrate thickness be smaller for high frequencies than for low frequencies is met.

In addition, the requirement that the antenna for the upper frequency band (formed by the first radiation electrode 130) must be closer to the ground area 110 and to the aperture 120 than the antenna for the lower frequency band (formed by the second radiation electrode 220 and the third radiation electrode 230) is met by means of the inventive geometry. If the larger patch were at the bottom (i.e. close to the aperture) and the smaller patch at the top (i.e. remote from the aperture), this would result in poor polarization characteristics in the upper frequency range, since the aperture would be shielded by the larger patch. In such a case, effective coupling of the small patch through the aperture would not longer be possible. Correspondingly, a smaller patch separated from the aperture by a larger patch would not be able to radiate a circularly polarized wave with a low portion of orthogonal polarization.

In addition, it is avoided by the inventive geometry in which the larger patch is composed of two parts, namely the second radiation electrode 220 and the third radiation electrode 230, that the radiation of the bottom smaller patch is shielded too strongly by the upper larger patch. When the antenna for the upper frequency band is closer to the ground area 110 than the antenna for the lower frequency band, the strong shielding of the small radiator by the large one should be avoided.

Reduced shielding of the radiation of the lower patch 130 by the upper patch 220, 230 is achieved by the gap 140 between the second radiation electrode 220 and the third radiation electrode 230.

The inventive radiator geometry 200 can also be changed considerably. All the alterations described before can be applied to the individual radiation electrodes 130, 220, 230. Exemplarily, it is of advantage to cut the corners of the corresponding radiation electrodes. Several modes necessary for circular radiation can be coupled, while undesired modes can be suppressed.

Figure 3:
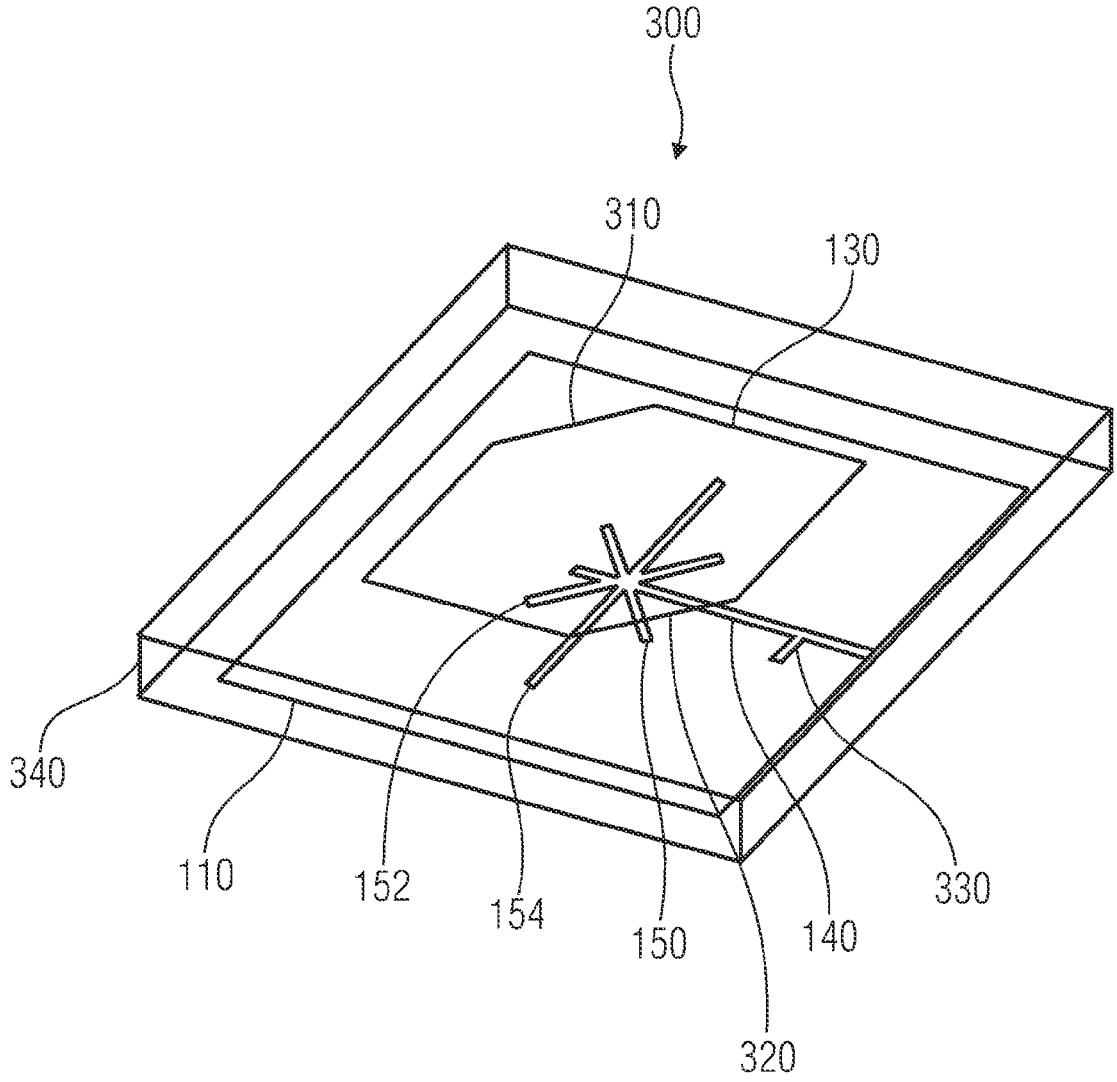
FIG. 3 shows a tilted image of a planar antenna structure from which an inventive antenna structure may be derived.

FIG. 3 shows a tilted image of a planar antenna structure from which an inventive antenna structure may be derived. The antenna structure in its entirety is referred to by 300. It basically corresponds to the antenna structure 100 shown referring to FIG. 1, so that same means and geometry characteristics here are provided with same reference numerals. Unchanged characteristics will not be described again. However, it is pointed out that in the antenna arrangement 300 a first corner 310 and a second corner 320 of the first radiation electrode 130 are cut off and/or bevelled. This geometrical alteration contributes to the fact that a circularly polarized electromagnetic wave can be radiated. In addition, the antenna arrangement 300 comprises a stub 330 applied to the strip line 140. This stub 330 serves further impedance matching of the present antenna structure. The dimensioning of such a stub for matching is known to one skilled in the art.

In addition, FIG. 3 shows an enclosing cuboid 340 enclosing the entire antenna structure. Such an enclosing cuboid may, for example, be used to delineate a simulation region in an electromagnetic simulation of an antenna structure.

Figure 4:
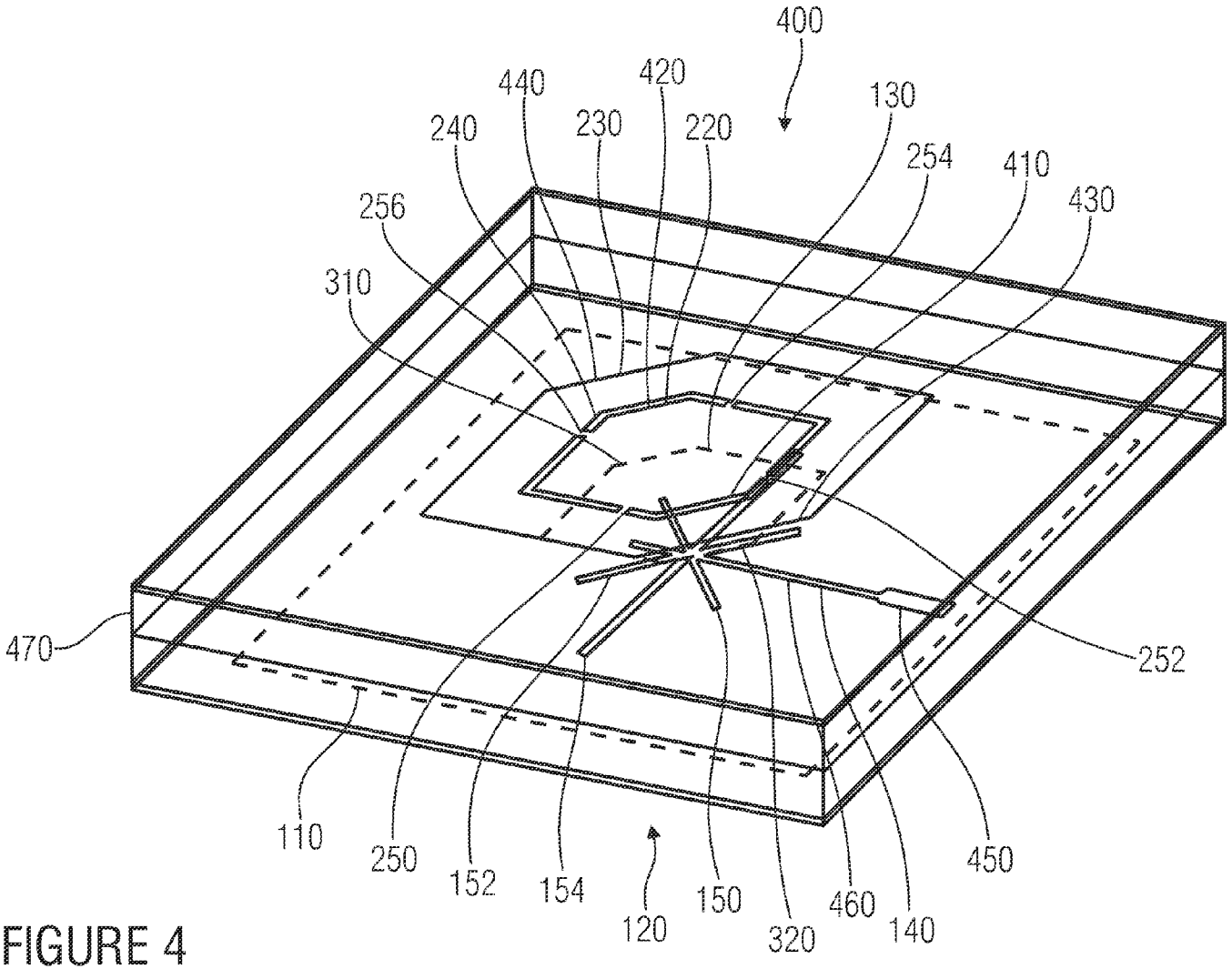
FIG. 4 shows a tilted image of an inventive antenna structure according to a second embodiment of the present invention.

FIG. 4 shows a tilted image of an inventive antenna structure according to a second embodiment of the present invention. The antenna structure in its entirety is referred to by 400. The antenna structure 400 includes a feed line 140, a ground area 110 having an aperture 120, and a first radiation electrode 130, a second radiation electrode 220 and a third radiation electrode 230. The geometry of the first radiation electrode 130 here basically corresponds to the geometry of the first radiation electrode 130 shown in FIG. 3. The second and third radiation electrodes 220, 230 are basically arranged as is described referring to FIG. 2. However, in the antenna structure 400, two opposite corners 410, 420 of the second radiation electrode 220 are bevelled. The third radiation electrode 230 in turn encloses the second radiation electrode 220, wherein there is a slot and/or gap 240 between the second radiation electrode 220 and the third radiation electrode 230. Additionally, it is to be pointed out that the third radiation electrode 230 in its shape is adjusted to the second radiation electrode 220. This means that the third radiation electrode 230 is adjusted to the bevelled corners 410, 420 of the second radiation electrode 220 such that the gap 240 between the second radiation electrode 220 and the third radiation electrode 230 basically has an equal width also in the region of the bevelled corners 410, 420. The inner edges of the third radiation electrode 230 thus are basically parallel to the external edges of the second radiation electrode 220. The third radiation electrode 230, too, comprises two external bevelled corners 430, 440 which are adjacent to the bevelled corners 410, 420 of the second radiation electrode 220. Thus, both the first, second and third radiation electrodes 130, 220, 230 comprise bevelled corners 310, 320, 410, 420, 430, 440, wherein the respective adjacent corners of the different radiation electrodes are bevelled. The second and third radiation electrodes 220, 230 are coupled via connecting lands 250, 252, 254, 256, wherein the connective lands 250, 252, 254, 256 are arranged roughly in the center of edges of a rectangle representing the second radiation electrode 220, except for the bevelled corners.

In addition, it is pointed out that the size of the second radiation electrode 220, except for a deviation of at most 20%, equals the size of the first radiation electrode 130. As to the shape, too, the first and second radiation electrodes 130, 220 do not differ considerably. Thus, they are nearly parallel electrodes of nearly equal shape having nearly the same dimensions.

The layer sequence is explicitly pointed out here again. The feed line 140 forms the bottommost conducting layer. A ground area 110 comprising an aperture 120 is arranged above it. The first radiation electrode 130 is arranged above this in one plane. The second radiation electrode 220 and the third radiation electrode 230 are arranged in another plane further up. The respective metallizations, i.e. the feed line 140, the ground area 110 and the first, second and third radiation electrodes 130, 220, 230, are each supported by dielectric layers.

Additionally, it is mentioned here that the width of the feed line 140 is changed for adjusting purposes. The feed line 140, away from the aperture, has a broad portion 450, whereas the feed line 140 is narrower close to the aperture. A narrow feed line is of advantage since it causes a greater concentration of the electrical field. Thus, a stronger coupling of the radiation electrodes can occur to the feed line through the aperture 120. Furthermore, the change in the width of the feed line also serves impedance matching, wherein matching can be influenced by suitably choosing the length of the thin piece 460.

Also shown is an enclosing rectangle 470 which delineates a simulation region in which the antenna structure is simulated. The enclosing rectangle also indicates the thickness of the respective layers.

Figure 5:
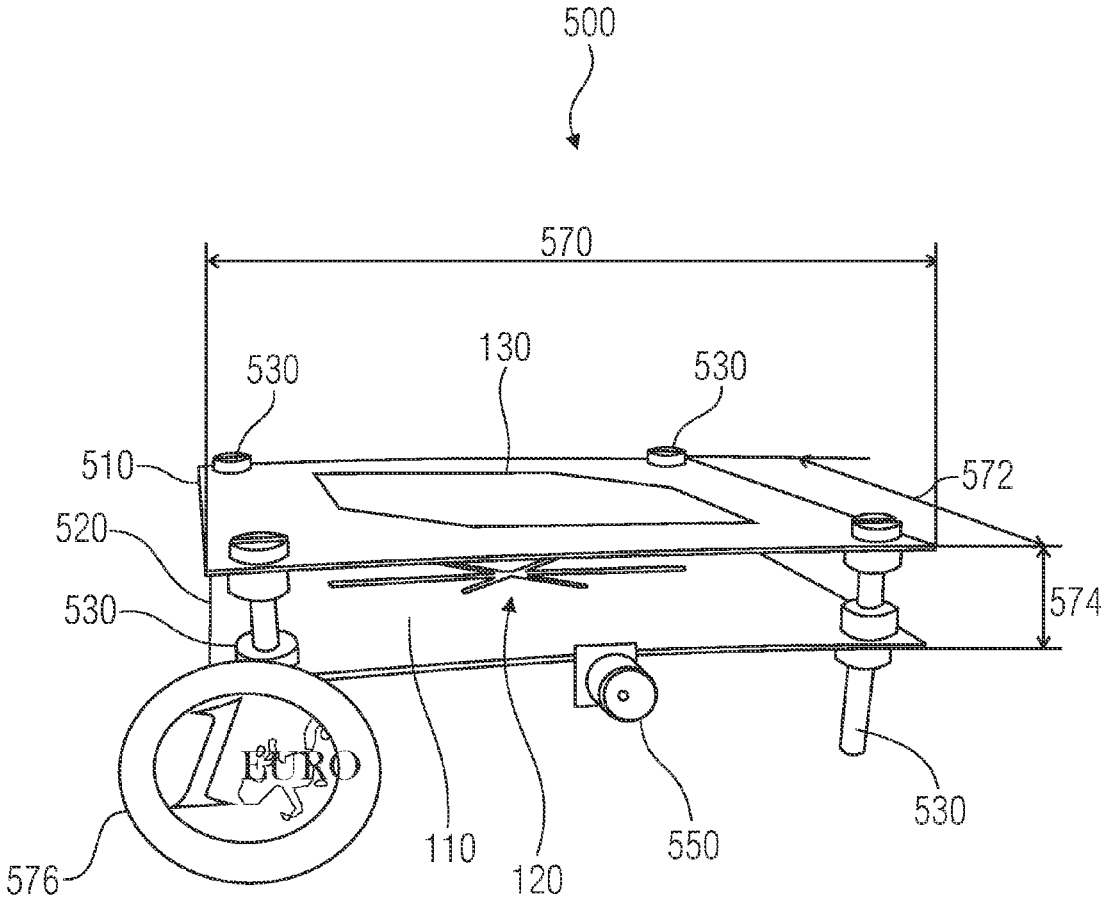
FIG. 5 shows a photograph of a planar antenna structure prototype from which an inventive antenna structure may be derived.

FIG. 5 shows a photograph of a planar antenna structure prototype from which an inventive antenna structure may be derived. A constructed monoband antenna is shown here, designed for the frequency range from 2.40 GHz to 2.48 GHz. The antenna in its entirety is referred to by 500. It comprises a first board 510 made of a dielectric material and a second board 520 made of a dielectric material. The two boards are separated and/or fixed by four spacers 530 made of a dielectric material. The first dielectric board 510 supports a first radiation electrode 130. The second dielectric board 520 supports, on an upper area, the ground area 110 comprising an aperture 120. The lower side of the dielectric board 530 supports a feed line via which electrical energy is fed to the antenna from an SMA socket 550.

The antenna arrangement 500 has a first dimension 570 of 75 mm which can be taken as a width. A second dimension 572 which can be taken as a length is also 75 mm. Finally, a third dimension 574 which can be taken as a height is 10 mm. Just for size comparison purposes, a one Euro coin 576 is shown here.

Figure 6:
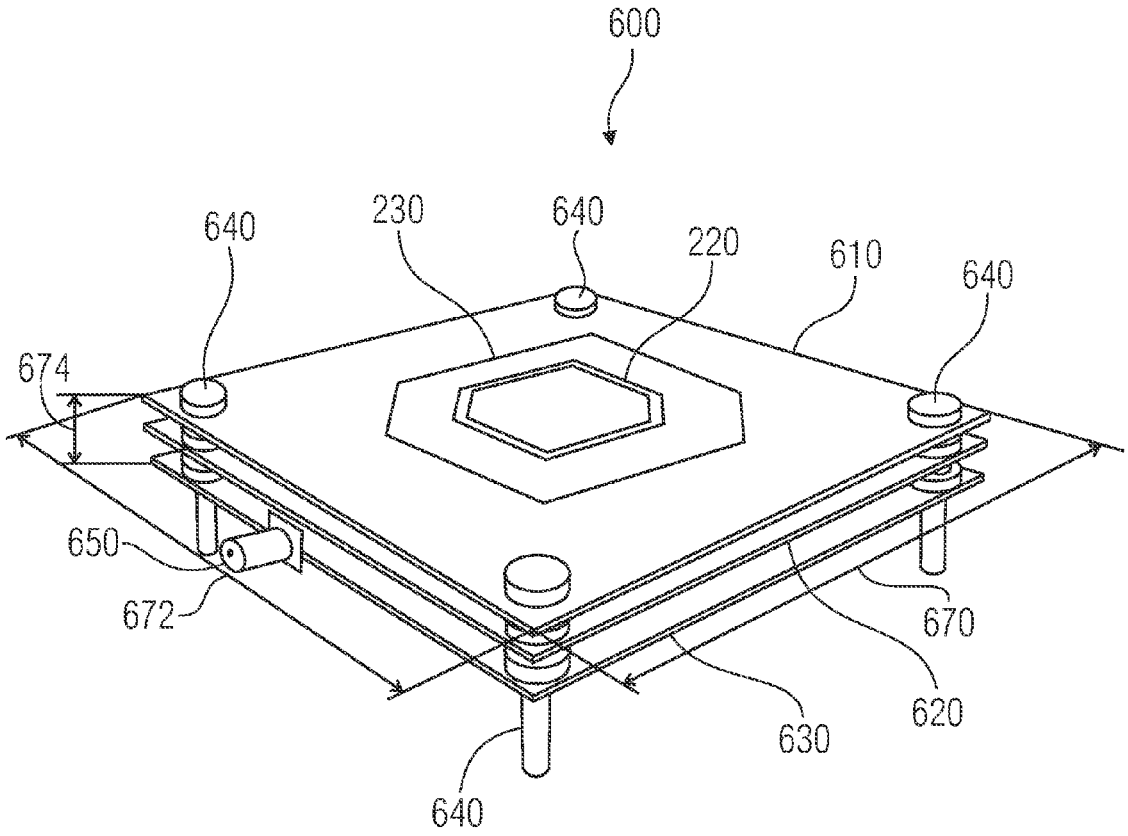
FIG. 6 shows a photograph of a prototype of an inventive antenna structure according to the second embodiment of the present invention.

FIG. 6 shows a photograph of a prototype of an inventive antenna structure according to the second embodiment of the present invention. The antenna structure in its entirety is referred to by 600. It includes a first dielectric layer 610, a second dielectric layer 620 and a third dielectric layer 630.

The 3 dielectric layers or boards 610, 620, 630 are supported by dielectric spacers 640. The first dielectric board 610 here supports a second radiation electrode 220 and a third radiation electrode 230. The second dielectric board supports a first radiation electrode 130. The third dielectric board 630 supports a ground area 110 on one side and a feed line 140 on the other side. The feed line is also led out to an SMA socket 650. The entire antenna structure 600 forms a dual-band antenna.

The antenna 600 has a first dimension 670 which can also be taken as a length. This first dimension is 75 mm. In addition, the antenna 600 has a second dimension 672 which can be taken as a width which is also 75 mm. A third dimension 674 of the antenna 600 can be taken as a height. This height is 10.5 mm.

The dual-band antenna 600 shown is based on the monoband antenna 500, wherein the monoband antenna has been improved to form a dual-band antenna. The antenna 600 which in its principle setup corresponds to the antenna 400 shown in FIG. 4 is set up of several layers which will be discussed in greater detail below. The bottommost sheet of the antenna is formed by a patterned conductive layer, exemplarily a metallization layer and/or metal layer which as a whole forms a microstrip line. This microstrip line is deposited on the bottom side of a first substrate of the type FR4, wherein the first substrate has a thickness of 0.5 mm. The first substrate corresponds to the third dielectric layer 630. A ground area having an overall extension of 75 mm×75 mm is deposited on the top of the first substrate. The ground area additionally includes an aperture 120. A layer which is not filled by a dielectric material is arranged above the ground area. Correspondingly, the antenna also includes an air layer having a thickness of 5 mm. Another conductive layer on which the first radiation electrode is formed as a patch is arranged above this air layer. The further conductive layer is supported by a second dielectric layer made of FR4 which again has a thickness of 0.5 mm. The second dielectric FR4 layer corresponds to the second dielectric layer 620 shown in FIG. 6. A layer in which there is no solid dielectric is arranged above the second dielectric FR4 layer. The result is a second air layer the thickness of which is 4 mm. A third dielectric FR4 layer having a thickness of 0.5 mm is arranged above it. The third dielectric FR4 layer supports another conductive layer on which the second radiation electrode and the third radiation electrode in the form of patches are formed by patterning. Conducting connecting lands between the second radiation electrode and the third radiation electrode have a width of 1 mm. The entire antenna structure thus includes the following layers in the order shown: microstrip line; FR4 (0.5 mm); ground area (75 mm×75 mm, including aperture); air (5 mm); patch 1 (first radiation electrode); FR4 (0.5 mm); air (4 mm); FR4 (0.5 mm) and patch 2 (second radiation electrode and third radiation electrode). All the layers and dimensions can be varied by up to 30%. However, it is of advantage for the deviation from the dimensions not to be more than 15%.

Figure 7:
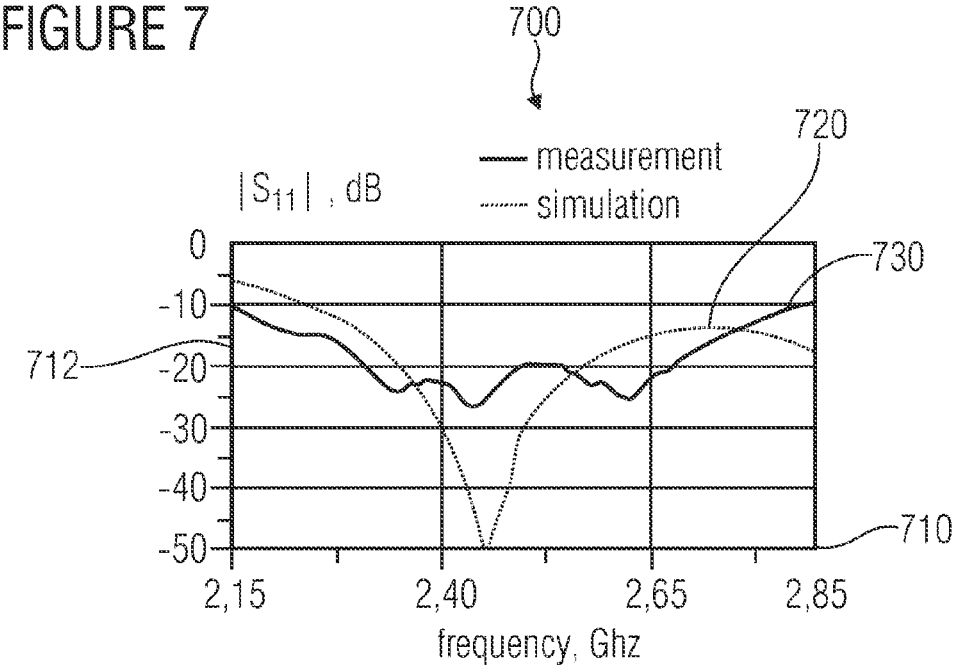
FIG. 7 shows a graphical illustration of the form of the reflection coefficient S11 for a planar antenna structure prototype from which the inventive antenna structure may be derived.

FIG. 7 shows a graphical illustration of the form of the reflection coefficient S11 for a prototype 500 of a planar antenna from which the inventive antenna structure may be derived. The graphical illustration in its entirety is referred to by 700. The input reflection factor S11 has been measured for a constructed patch antenna which is designed for a frequency range from 2.40 to 2.48 GHz. A photograph of such an antenna 500 is shown in FIG. 5.

The frequency of 2.15 GHz to 2.85 GHz is plotted on the abscissa 710. The ordinate 712 shows, in logarithmic style, the magnitude of the input reflection factor S11. Here, the input reflection factor is plotted in a range from −50 dB to 0 dB. A first graph 720 shows a simulated input reflection factor. A second graph 730 shows the measured value for the input reflection factor. According to the measurement, the input reflection factor is below −10 dB in the entire frequency range shown from 2.15 GHz to 2.85 GHz. The simulation, too, shows a similar broadband characteristic of the antenna.

Figure 8:
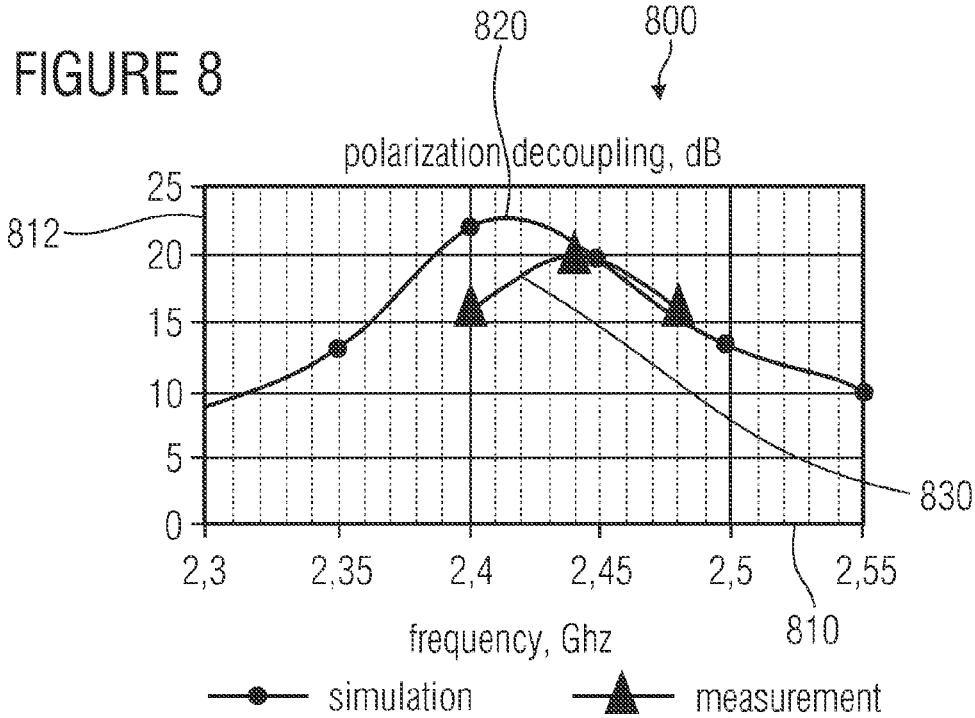
FIG. 8 shows a graphical illustration of the form of the polarization decoupling for a planar antenna structure prototype from which the inventive antenna structure may be derived.

FIG. 8 shows a graphical illustration of the polarization decoupling for a prototype 500 of a planar antenna structure from which the inventive antenna structure may be derived. The graphical illustration in its entirety is referred to by 800. The frequency in a range from 2.3 GHz to 2.55 GHz is plotted on the abscissa 810. The ordinate 812 shows the polarization decoupling in decibels in a range between 0 and 25 dB. A first graph 820 shows a simulated form of the polarization decoupling, whereas a second graph 830 shows the measured values. In the necessary bandwidth of 2.40 GHz to 2.48 GHz, the cross-polarization, with a sufficient adjusting factor, is suppressed by more than 15.5 dB.

Figure 9:
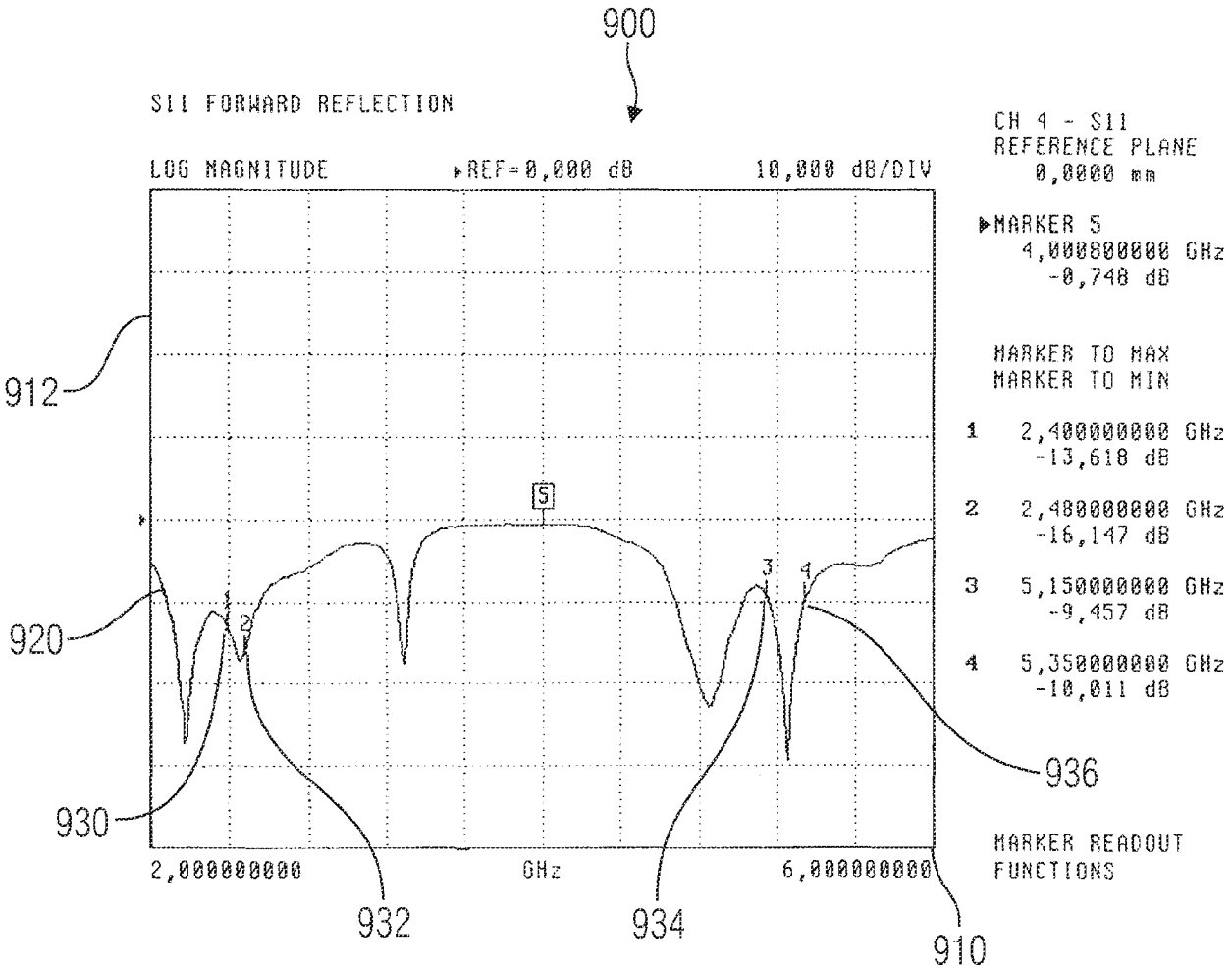
FIG. 9 shows a graphical illustration of the form of the reflection coefficient S11 for a prototype of an inventive antenna according to the second embodiment of the present invention.

FIG. 9 shows a graphical illustration of the form of the reflection coefficient S11 for a prototype 600 of an inventive antenna according to the second embodiment of the present invention. The graphical illustration in its entirety is referred to by 900. Measuring results are shown here for the reflection coefficient of an inventive dual-band antenna, as has been described referring to FIGS. 4 and 6. The abscissa 910 here shows the frequency range between 2 GHz and 6 GHz. The magnitude of the input reflection factor S11 in logarithmic style is plotted on the ordinate 912 from −40 dB to +40 dB. A graph 920 shows the form of the input reflection factor relative to frequency. Also shown are a first marker 930, a second marker 932, a third marker 934 and a fourth marker 936. The first marker shows that the input reflection factor at 2.40 GHz is −13.618 dB. The second marker shows an input reflection factor of −16.147 dB at 2.48 GHz. The third marker shows an input reflection factor of −9.457 dB at 5.15 GHz, and the fourth marker shows an input reflection factor of −10.011 dB at 5.35 GHz. The fifth marker finally shows an input reflection factor of −0.748 dB at 4.0008 GHz.

It shows that the input reflection factor in the ISM band between 2.40 GHz and 2.48 GHz is less than −13 dB and that the input reflection factor in the ISM band between 5.15 GHz and 5.35 GHz is less than −9.4 dB.

Apart from the input reflection factor, the radiation characteristics of the dual-band antenna were also measured. In the ISM band between 2.40 GHz and 2.48 GHz, the antenna gain of a prototype of a dual-band antenna is between 7.9 dBic and 8.3 dBic. The half-width is here 70° and the polarization decoupling is between 11 dB and 22 dB.

In the ISM band between 5.15 GHz and 5.35 GHz, the antenna gain is between 5.9 dBic and 7.3 dBic. The half-width is 35°, the polarization decoupling is between 5 dB and 7 dB.

The necessary adjusting characteristics and radiation characteristics can be achieved by an inventive dual-band antenna. Furthermore, it is to be mentioned that the polarization purity for the upper frequency range can still be optimized. Geometrical details may, for example, be altered.

Exemplarily, a resonant fork-shaped cross-aperture may be used. For such an aperture, according to a simulation in the ISM band between 2.40 GHz and 2.48 GHz, an antenna gain up to 7.5 dBic, a half-width of 70° and a polarization decoupling up to 30 dB result. In the ISM band between 5.15 GHz and 5.35 GHz, according to a simulation, an antenna gain up to 7 dBic, a half-width of 35° and a polarization decoupling up to 17 dB can be achieved.

In summary, it can be stated that the present invention provides a planar circularly polarized antenna which may be used in the ISM bands of 2.40 GHz to 2.48 GHz and 5.15 GHz to 5.35 GHz. The suggested shape of the slot for an aperture-coupled patch antenna allows radiating nearly purely circularly polarized waves at a relatively large bandwidth of the reflection coefficient S11. This is also possible for multiband antennas. A radio link can be achieved by an inventive antenna, wherein the intensity of the signal received by an inventive antenna at a linear polarization of a transmitter is independent of the insertion position of the receive antenna. Put differently, a linearly polarized signal can be received by a circularly polarized antenna, independently of the orientation of the antenna.

The inventive antenna has been developed in several steps. A first sub-task was developing an aperture-coupled antenna for a frequency range of 2.40 to 2.48 GHz having a right-hand circular polarization (RHCP). In simulation, it has been paid attention to that a strong suppression of the orthogonal polarization within the bandwidth necessary is achieved. Thus, it has been found out that cross-polarization is suppressed strongly when feeding a patch through a non-resonant cross-aperture. However, in such a non-resonant cross-aperture, the bandwidth of the reflection coefficient is narrow. A resonant rectangular aperture (so-called SSFIP principle) comprises a larger bandwidth, wherein, however, polarization decoupling is weaker. Finally, a combination of the two slot geometries not known before has proven to be of advantage, which is here referred to as resonant cross-aperture. A corresponding antenna geometry has been shown in FIGS. 1, 3 and 5.

Furthermore, it has shown that a geometry shown of the aperture and/or the slot also allows setting up circularly polarized dual- and/or multiband antennas. The concept to be described below may be used here. In the case of two bands, the antenna includes three boards. Corresponding arrangements are, for example, shown in FIGS. 4 and 6. On the bottom side of the bottom printed circuit board, there is a microstrip line the power of which couples through an aperture in the ground area first to a small patch (for the upper frequency band) and then a larger patch (for the two frequency bands) including two patches. Thus, the larger patch can be interpreted as "two patches within each other having short circuits". The inner smaller patch has the same size as the bottom patch.

A number of problems occurring in conventional antennas can be solved by such a structure and/or such a dual-band concept.

In order to achieve the largest bandwidth possible, radiators to be considered separate from one another must have, for both frequency ranges, relatively thick substrates of low permittivity.

However, increasing the electrical substrate thickness conventionally results in higher-order surface waves forming, which strongly reduces the antenna gain, as will be discussed below. Conventionally, two patches for different frequency bands can be within each other on a common substrate. The thickness of the substrate can be determined as a maximum of substrate thicknesses calculated of separate antennas where the separate antennas comprise the bandwidth necessary. However, if the higher frequency band is separated from the lower frequency band by roughly one octave and if the minimum substrate thickness for the larger patch when being used in the upper frequency range is so thick that this results in a high level of higher-order surface waves, the surface waves will strongly reduce the antenna gain for the upper frequency range. Thus, the two antennas must have different substrate thicknesses for different frequency ranges. The antennas for different frequency ranges consequently have to be in different planes. This can be achieved by means of an inventive antenna geometry.

A conventional variation with a larger bottom patch and a smaller top patch comprises poor polarization characteristics, since the aperture is shielded by the larger patch. The antenna for the upper frequency band consequently has to be closer to ground than the antenna for the lower frequency band, which can be achieved by an inventive geometry.

Since the antenna for the upper frequency band thus must be closer to the ground area than the antenna for the lower frequency band, strong shielding of the small radiator for the upper frequency band by the large radiator for the lower frequency band should be avoided. This can be achieved by forming the radiator for the lower frequency band by two radiation electrodes between which there is a gap.

Adjusting an inventive antenna can be performed by a transformer and/or a stub.

Compared to conventional antennas, an inventive antenna has a number of advantages. The suggested dual-band concept allows setting up completely planar antennas which can easily be manufactured in mass production and are thus cheaper. At the same time, high polarization purity and large impedance bandwidth can be achieved. In addition, planar circularly polarized multiband antennas can be constructed. Thus, the area consumption of the entire antenna is determined only by the size of the antenna element for the lowest frequency. Compared to broadband antennas, an inventive antenna still offers better pre-filtering.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

While preferred embodiments of the present invention have been described above, it is to be understood that variations and modifications will be apparent to those skilled in the art without departing the scope and spirit of the present invention. The scope of the present invention, therefore, is to be determined solely by the following claims.

The invention claimed is:

1. A planar multiband antenna, comprising:

a ground area;

a first radiation electrode, a second radiation electrode and a third radiation electrode; and a feeder which is implemented to feed the first radiation electrode, wherein the first radiation electrode is arranged at least partly between the ground area and the second radiation electrode and does not protrude from an external periphery of the third radiation electrode;

wherein the third radiation electrode is arranged to completely surround an external periphery of the second radiation electrode with a gap therebetween;

wherein the third radiation electrode is arranged on that side of the first radiation electrode facing away from the ground area; and wherein the third radiation electrode and the second radiation electrode are connected to each other via four conductive connection lands.

2. The planar multiband antenna according to claim 1, wherein the third radiation electrode is implemented such that, in a projection of the second radiation electrode and the third radiation electrode along a direction normal to the second radiation electrode in an image plane, an image of the third radiation electrode completely encloses an image of the second radiation electrode.

3. The planar multiband antenna according to claim 1, wherein the second radiation electrode and the third radiation electrode are in one plane, wherein the third radiation electrode completely encloses the second radiation electrode in the plane.

4. The planar multiband antenna according to claim 1, wherein a distance between the third radiation electrode and the second radiation electrode is smaller than a distance between the third radiation electrode and the first radiation electrode.

5. The planar multiband antenna according to claim 1, wherein the first radiation electrode, the second radiation electrode, the third radiation electrode and the feeder are implemented such that the planar multiband antenna is able to radiate a circularly polarized electromagnetic wave.

6. The planar multiband antenna according to claim 1, wherein the feeder includes an aperture in the ground area and a wave guide, wherein the first radiation electrode, the second radiation electrode and the third radiation electrode are arranged spaced apart from the ground area on a first side of the ground area, and wherein the wave guide is arranged on a second side of the ground area; and wherein the wave guide and the first radiation electrode are arranged such that energy from the wave guide can be coupled through the aperture to the first radiation electrode to feed the first radiation electrode.

7. The planar multiband antenna according to claim 6, wherein the wave guide and the aperture are implemented to allow radiation of a circularly polarized electromagnetic wave.

8. The planar multiband antenna according to claim 7, wherein the aperture comprises at least a first slot and a second slot which together form a slot in the shape of a cross.

9. The planar multiband antenna according to claim 1, wherein the first radiation electrode and the second radiation electrode comprise equal shapes.

10. The planar multiband antenna according to claim 1, wherein a maximum dimension of the second radiation electrode differs by at most 30% from a maximum dimension of the first radiation electrode.

11. The planar multiband antenna according to claim 1, wherein the third radiation electrode and the second radiation electrode are coupled to each other via a conductive connection.

12. The planar multiband antenna according to claim 1, wherein the third radiation electrode and the second radiation electrode are coupled to each other via at least one conductive connection land.

13. The planar multiband antenna according to claim 1, wherein a plane in which the first radiation electrode is arranged forms a positive angle of at most 20 degrees with the ground area, wherein a plane in which the second radiation electrode is arranged forms a positive angle of at most 20 degrees with the ground area, and wherein a plane in which the third radiation electrode is arranged forms a positive angle of at most 20 degrees with the ground area.

14. The planar multiband antenna according to claim 1, which is implemented such that impedance matching of a standing wave ratio of less than 2 is achieved in at least two frequency bands.

15. The planar multiband antenna according to claim 1, comprising a first dielectric layer, a first layer of low dielectric constant, a second dielectric layer, a second layer of low dielectric constant, and a third dielectric layer, wherein the first dielectric layer supports a the wave guide on its first surface and supports the ground area on its second surface, wherein the second dielectric layer supports the first radiation electrode on a surface;

wherein the third dielectric layer supports the second radiation electrode and the third radiation electrode;

wherein the first layer of low dielectric constant is arranged between the first dielectric layer and the second dielectric layer;

wherein the second layer of low dielectric constant is arranged between the second dielectric layer and the third dielectric layer;

wherein a dielectric constant of the first layer of low dielectric constant is smaller than a dielectric constant of the first dielectric layer, wherein the dielectric constant of the first layer of low dielectric constant is smaller than a dielectric constant of the second dielectric layer, and wherein the dielectric constant of the first layer of low dielectric constant is smaller than a dielectric constant of the third dielectric layer; and wherein a dielectric constant of the second layer of low dielectric constant is smaller than the dielectric constant of the first dielectric layer, wherein the dielectric constant of the second layer of low dielectric constant is smaller than the dielectric constant of the second dielectric layer, and wherein the dielectric constant of the second layer of low dielectric constant is smaller than the dielectric constant of the third dielectric layer.

16. The planar multiband antenna according to claim 15, wherein the first, second or third dielectric layer consists of FR4 material.

17. The planar multiband antenna according to claim 15, wherein the first layer of low dielectric constant or the second layer of low dielectric constant is an air layer.

* * * * *